US005878649A

United States Patent [19]

Raab

[11] Patent Number: 5,878,649

[45] Date of Patent: Mar. 9, 1999

[54] CONTROLLED PORTING FOR A PRESSURE TRANSFORMER

[75] Inventor: Francis J. Raab, Chillicothe, Ill.

[73] Assignee: Caterpillar Inc., Peoria, Ill.

[21] Appl. No.: 56,515

[22] Filed: Apr. 7, 1998

[51] Int. Cl.[6] ..... F01B 3/00

[52] U.S. Cl. ..... 92/12.2; 92/57; 92/71; 417/269

[58] Field of Search ..... 417/269; 92/12.2, 92/57, 71

[56] References Cited

U.S. PATENT DOCUMENTS

| | | | |
|---|---|---|---|
| 4,034,652 | 7/1977 | Huebner | 91/499 |
| 4,212,596 | 7/1980 | Ruseff | 417/216 |
| 4,976,284 | 12/1990 | Hovarter | 417/269 X |
| 5,147,190 | 9/1992 | Hovarter | 417/269 X |
| 5,702,236 | 12/1997 | Ikeda | 417/269 |
| 5,709,535 | 1/1998 | Enomoto et al. | 417/269 |

FOREIGN PATENT DOCUMENTS

WO9731185 8/1997 WIPO .

OTHER PUBLICATIONS

Application: "Transforming Future Hydraulics: A New Design of a Hydraulic Transformer" Peter A.J. Achten PhD, et al. Netherlands (No Date).

*Primary Examiner*—Hoang Nguyen
*Attorney, Agent, or Firm*—J. W. Burrows

[57] ABSTRACT

A pressure transformer is provided having a housing, with a rotating group disposed therein, an adjustable port plate is disposed between a barrel of the rotating group and a head portion of the housing. The barrel has a plurality of pistons slideably disposed in cylinders defined in the barrel. The cylinders each define a cylinder port that is in intimate contact with the port plate. Each cylinder port has a predetermined circumferential length. The port plate has three arcuate slots defined therein and spaced from one another along a predetermined circumference. Each arcuate slot has a leading edge and a trailing edge. Likewise each of the cylinder ports has a leading edge and a trailing edge. The shape and orientation of the leading edges and trailing edges of the cylinder ports and the arcuate slots are the same. The circumferential length of the space between adjacent ones of the arcuate slots is less than the circumferential length of the respective cylinder ports. During relative rotation between the cylinder ports and the arcuate slots, the cylinder ports is in communication with the adjacent arcuate slots but during operation the communication is effectively dynamically sealed. This relationship enhances the operating efficiency of the pressure transformer by conditioning the fluid within the cylinder so that the pressure therein is equivalent to the pressure in the successive arcuate port upon opening thereto.

8 Claims, 4 Drawing Sheets

CONTROLLED PORTING FOR A PRESSURE TRANSFORMER

TECHNICAL FIELD

This invention relates generally to the porting for a hydraulic pressure transformer and more particularly to the relationship between the circumferential length of the ports in a rotating unit of a pressure transformer relative to the space between ports or kidney slots in a port plate therein.

BACKGROUND ART

In known hydraulic pressure transformers, the ports in the rotating unit are normally circular in cross-section and the ends of the respective ports in the port plate are normally semi-circular in cross-section. Consequently, as the respective ones of the ports in the rotating unit initiates communication with the respective ones of the slots in the port plate, the opening is small and increase in size to its maximum amount. Since this communication is happening at locations other than top or bottom dead center positions, the instantaneous velocity of the pistons within the rotating unit is high. Likewise, the volume of fluid being received or expelled is high. Since the initial opening is small, the high volume of fluid does not have a free, unrestricted path and the system efficiency is adversely affected. Additionally, in known pressure transformers, the circumferential space between the adjacent arcuate slots is longer than the circumferential length of the respective cylinder ports in the rotating unit. Consequently, at the times that the piston velocity is high and the flow being introduced or expelled from the piston cylinder is also high, the cylinder is totally blocked thus resulting in the trapped fluid being compressed prior to the cylinder opening to one of the arcuate slots.

The present invention is directed to overcoming one or more of the problems as set forth above.

DISCLOSURE OF THE INVENTION

In one aspect of the present invention, a pressure transformer is provided for the conversion of hydraulic power from a first fluid flow having a first fluid pressure into the hydraulic power of a second fluid flow having a second pressure by controlling a third fluid flow having a third pressure. The hydraulic pressure transformer has a housing with three port connections, a rotating group having a barrel with a face surface and a plurality of piston assemblies each slideably disposed in respective cylinders. Each of the cylinders has a cylinder port defined in the barrel and opening to the face surface. Each of the cylinder ports is spaced from one another around a predetermined circumference. A displacement control mechanism is operatively associated with the respective piston assemblies to control the volume of fluid within each cylinder between a minimum and a maximum volume as the rotating group rotates. An adjustable port plate having a face surface with three arcuate slots defined therein is disposed in the housing. The arcuate slots are spaced from one another around a predetermined circumference that is substantially equal to the predetermined circumference of the cylinder ports. The face surface of the adjustable port plate is in mating contact with the face surface of the rotating group and each of the three arcuate slots is in communication with respective ones of the three ports in the housing. Each cylinder port has a leading edge, a trailing edge, and first and second spaced apart circumferential sides. The leading edge and the trailing edge of each cylinder port is spaced from one another a predetermined circumferential distance. Each arcuate slot has a leading edge, a trailing edge, and first and second spaced apart circumferential sides. The trailing edge of one of the arcuate slots and the leading edge of an adjacent slot being spaced from one another a predetermined circumferential distance. The predetermined circumferential distance between the adjacent slots being less than the predetermined circumferential distance between the leading edge and the trailing edge of the respective cylinder slots. During relative rotation between the barrel and the port plate, the leading edge of the respective cylinder ports is in an open, overlapping relationship with one of the arcuate slots. The trailing edge of the same cylinder port is in an open, overlapping relationship with the second one of the arcuate slots.

BEST MODE FOR CARRYING OUT THE INVENTION

Figure 1:
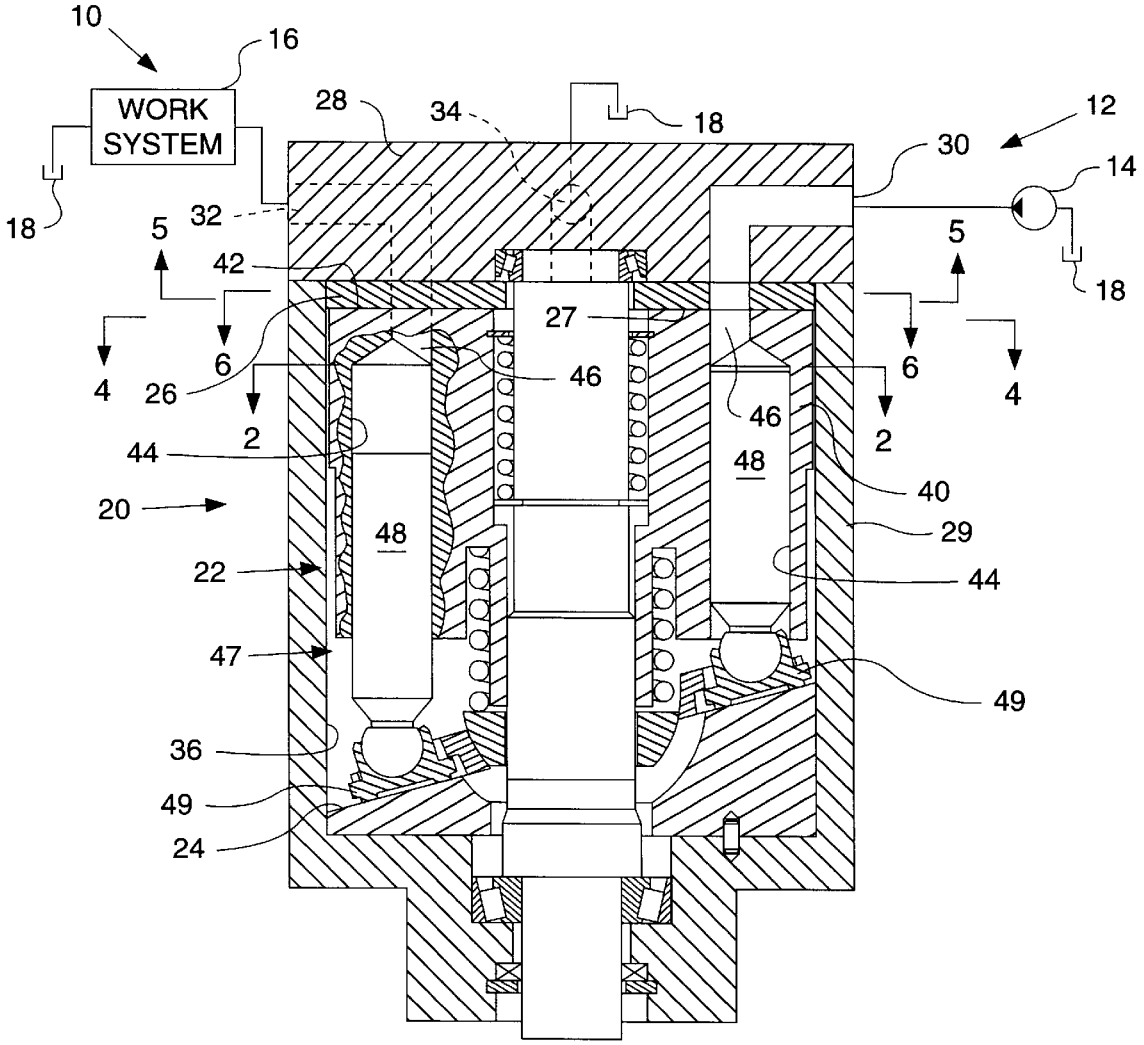
FIG. 1 is a cross-sectional view of a diagrammatic representation of a pressure transformer incorporating an embodiment of the subject invention.
Figure 2:
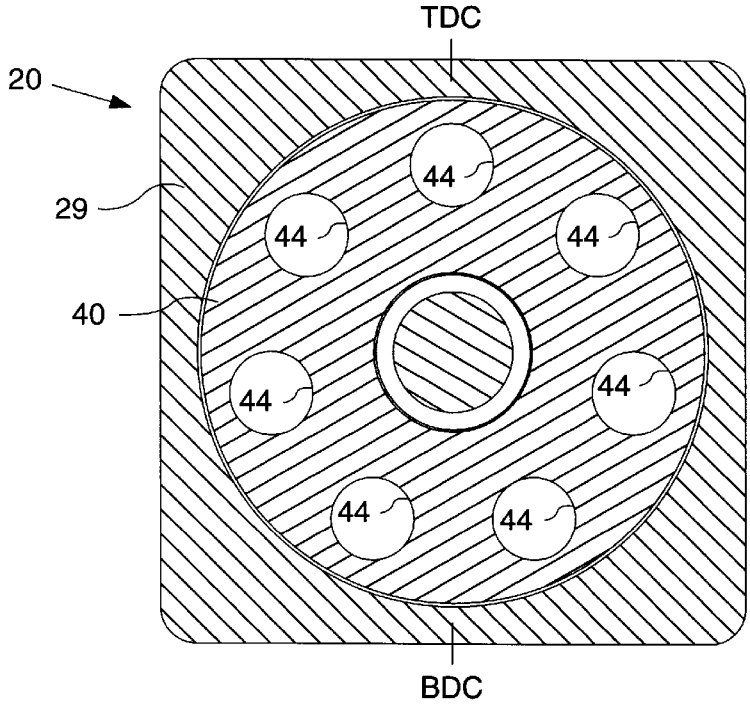
FIG. 2 is a view taken along the line 2—2 of FIG. 1.

Referring to FIGS. 1 and 2 of the drawings, a pressure transformer 10 is diagrammatically illustrated. The pressure transformer 10 is adapted for use in a fluid system 12 having a source 14 of pressurized fluid operating at a first pressure level, a work system 16 operating at a second, intermediate pressure level and a reservoir 18 that is operated at a low pressure or at atmospheric pressure.

The pressure transformer 10 includes a housing 20, a rotating group 22, a displacement controller 24, and an adjustable port plate 26 having a face surface 27. The housing 20 includes a head portion 28 and a body portion 29. The head portion 28 has a first port 30 connected to the source 14 of pressurized fluid, a second port 32 connected to the work system 16, and a third port 34 connected to the reservoir 18. The body portion 29 defines a chamber 36 adapted to receive the rotating group 22 and the displacement controller 24. The adjustable port plate 26 is disposed within the housing 20 between the head portion 28 and the rotating group 22.

The rotating group 22 includes a barrel 40 having a face surface 42 and a plurality of cylinders 44 defined in the barrel 40. The face surface 42 of the barrel 40 is in mating contact with the face surface 27 of the port plate 26. Each cylinder of the plurality of cylinders 44 has a cylinder port 46 defined in the barrel 40 between the respective ones of the cylinders 44 and the face surface 42. The cylinder ports 46 are spaced from one another around a predetermined circumference. The rotating group 22 also includes a plurality of piston assemblies 47 each having a piston 48 slideably disposed in the respective cylinders 44 and an attached shoe 49 that is in sliding contact with the displacement controller 24. In a well known manner, the respective pistons 48 are moveable between a bottom dead center (BDC) position and a top dead center (TDC) position. The movement of the respective pistons 48 from the BDC position to the TDC position controls the volume of fluid being delivered therefrom between a minimum and a maximum volume.

As more clearly illustrated in FIG. 2, the subject embodiment includes seven cylinders 44. It is recognized that a greater or lesser number of cylinders 44 could be used without departing from the essence of the subject invention. FIGS. 2, 4–6, as previously noted, are taken from FIG. 1, However, it should be noted that these Figs. have been rotated 90 degrees for illustrative purposes.

Figure 3:
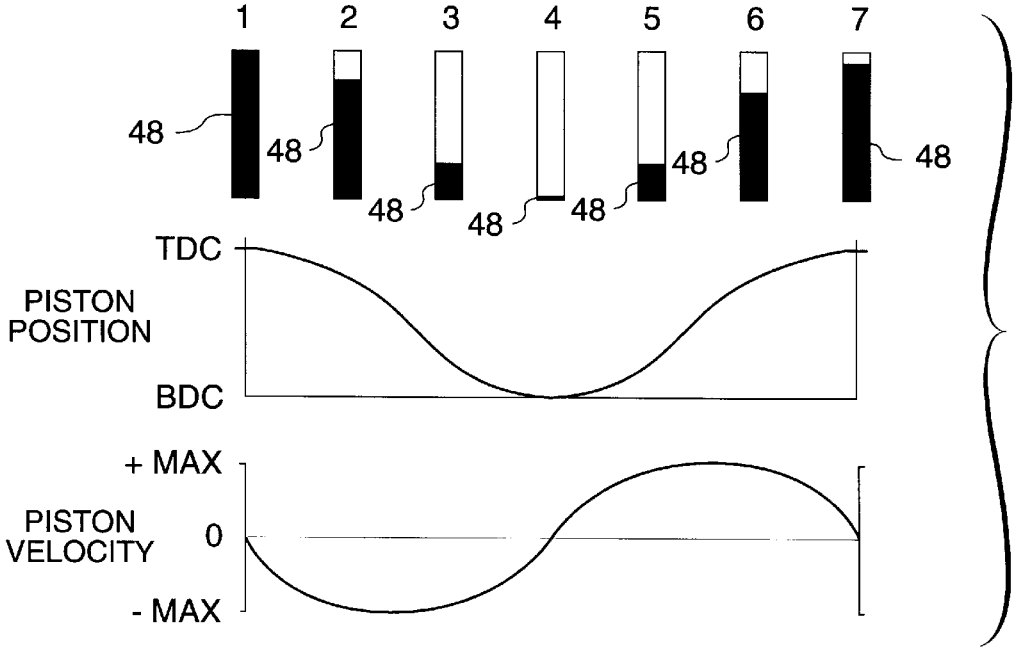
FIG. 3 is a graphic representation illustrating the relationship of the volume of fluid within a cylinder and the position of the piston within the cylinder relative to the velocity of the piston.

Referring to FIG. 3, a graphic representation is provided. The respective bar graphs and following line graphs depict the relationship of the position of the respective pistons 48 within their cylinders 44 and the instantaneous velocity of the piston at that instance. It should be noted that the velocity of the pistons increases from zero to a maximum velocity (+MAX/−MAX) in two different directions. The velocity of the respective pistons 48 is zero when the piston is at either the TDC or BDC position. As illustrated, the number 1 piston is at its TDC position. All of the fluid in the cylinder 44 has been expelled and the velocity of the piston 48 is zero. As illustrated by the number 2 and 3 pistons, the piston 48 is being retracted towards the BDC position and the cylinder is being filled with fluid. The velocity of the piston 2 is being increased towards −MAX and the velocity of the piston 3 has already reached −MAX velocity and is being reduced towards zero velocity. Piston number 4 is near the BDC position and is about full of fluid and its velocity is near zero. Pistons 5,6,7 are moving in the direction towards the TDC position and expelling fluid from the respective cylinders 44. As illustrated, the velocity of the piston 5 is increasing towards +MAX velocity and the piston 6 has about reached its +MAX velocity. The piston 7 is being reduced in velocity as it nears the TDC position and likewise most of the fluid has been expelled from the associated cylinder 44.

Figure 4:
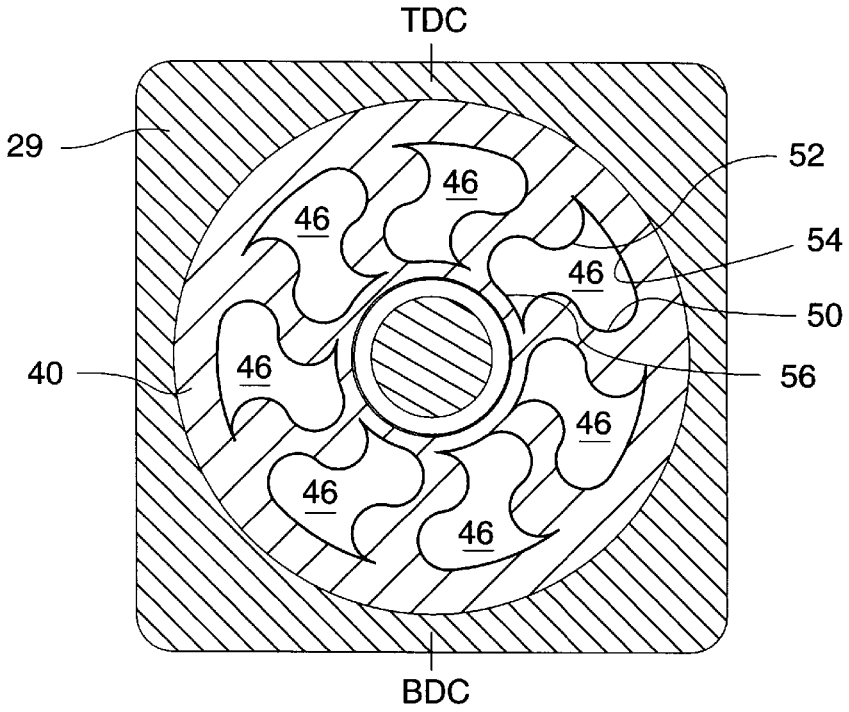
FIG. 4 is a view taken along the line 4—4 of FIG. 1.

Referring to FIG. 4, a more detailed view of the cylinder ports 46 is illustrated. Each of the cylinder ports 46 are identical in shape. Therefore, only one of the cylinder ports 46 is described in detail. Each of the cylinder ports 46 in the barrel 40 is defined by a leading edge 50, a trailing edge 52 and first and second spaced apart circumferential sides 54,56. In the subject embodiment, the shape of the leading and trailing edges 50,52 is generally wave shaped. It is recognized that other non-linear shapes could be used without departing from the essence of the subject invention.

Figure 5:
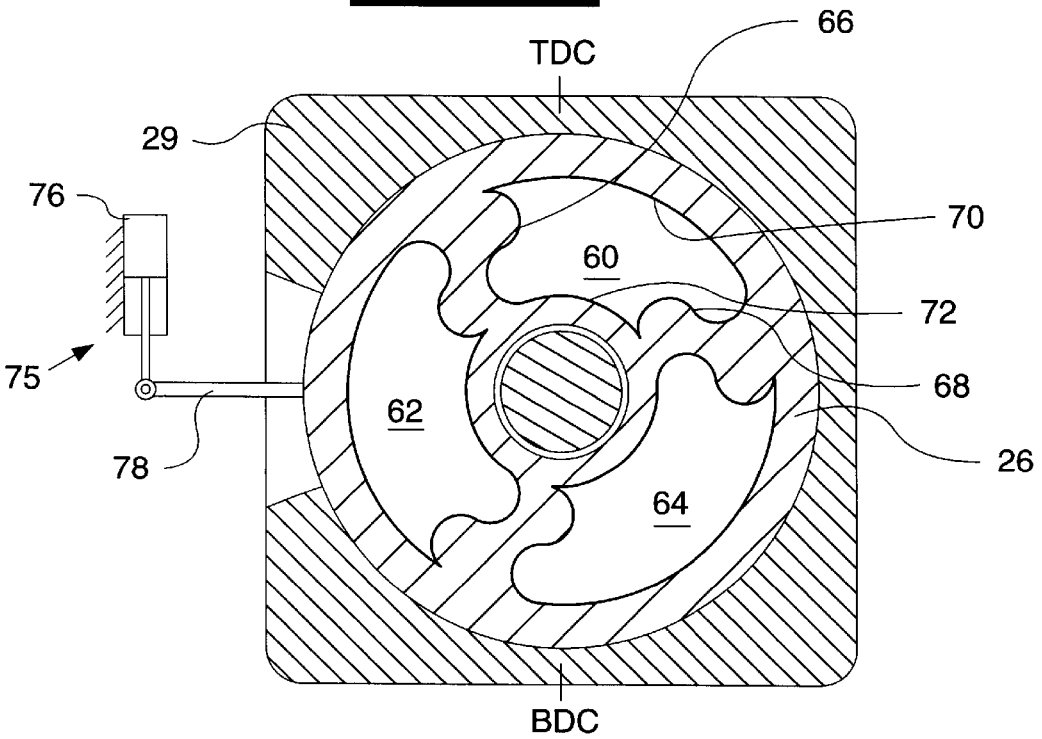
FIG. 5 is a view taken along the line 5—5 of FIG. 1.

Referring to FIG. 5, a more detailed view of the adjustable port plate 26 is illustrated. The port plate 26 has first, second and third arcuate slots 60,62,64 defined therein extending therethrough from the face surface 27. The three arcuate slots are defined in the port plate spaced from one another around a predetermined circumference. The predetermined circumference of the arcuate slots in the port plate is substantially the same as the predetermined circumference of the cylinder ports 46 in the barrel 40. The shape of each of the arcuate slot 60,62,64 is generally the same. Consequently only the arcuate 60 is described in detail. The arcuate slot 60 is defined in the port plate 26 by a leading edge 66, a trailing edge 68 and first and second spaced apart circumferential sides 70,72. The circumferential length of the respective arcuate slots may vary but the shape of the respective leading and trailing edges 66,68 remains the same. The shape and orientation of the leading edges 66 of the arcuate slots 60,62,64 are the same as the shape and orientation of the leading edges 50 of the respective cylinder ports 46 in the barrel 40.

Likewise, the shape and orientation of the trailing edges 68 of the arcuate slots 60,62,64 are the same as the shape and orientation of the trailing edges 52 of the respective cylinder ports 46 in the barrel 40. In the subject embodiment, the shape and orientation of the leading and trailing edges 66,68 of the arcuate slots 60,62,64 in the port plate 26 and the leading and trailing edges 50,52 in the cylinder ports 46 of the barrel 40 are the same. However, it is recognized that the leading edges 66/50 could be different in shape and orientation as compared to the trailing edges 68/52 without departing from the essence of the subject invention.

As further illustrated in FIG. 5, the port plate 26 is adjustable by an adjusting mechanism 75. The adjustable mechanism 75 functions to rotate the port plate 26, and therefore the respective arcuate slots 60,62,64, within the housing 20 relative to the TDC and BDC positions, which effectively adjusts the position that the respective cylinder ports 46 open into the respective arcuate slots 60,62,64. Consequently, the location of the arcuate slots 60,62,64 relative to the TDC and BDC positions may be varied.

The adjusting mechanism 75 includes a cylinder arrangement 76 and an arm 78 extending from the port plate 26 and connected to the cylinder arrangement. Extension or retraction of the cylinder arrangement 76 results in the port plate 26 being rotated in one direction or the other. The adjusting mechanism 75 of the subject embodiment illustrates that the port plate 26 is movable approximately thirty degrees in either direction. It is to be recognized that the port plate 26 may be movable to a greater degree. The adjusting mechanism illustrated herein is for illustrative purposes only. Other types of adjusting mechanisms 75 may be used. For example, the port plate 26 could have teeth around its circumference and a worm gear could be in mesh with the teeth. Rotation of the worm gear by any suitable means would result in rotation of the port plate 26. This would provide unlimited amounts of port plate rotation.

Figure 6:
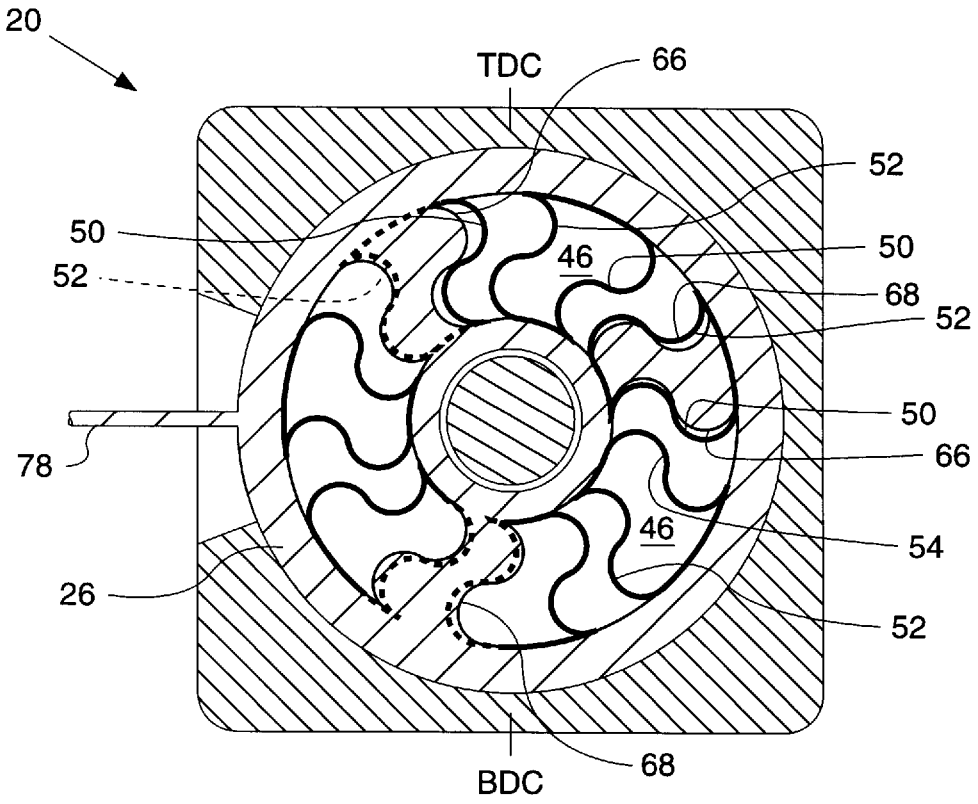
FIG. 6 is a view taken along the line 6—6 of FIG. 1.

Referring to FIG. 6, the port plate 26 is illustrated on top of the barrel 40 in order to better show the relationship of the arcuate slots 60,62,64 and the respective cylinder ports 46. The outline of the cylinder ports 46 is shown in heavy, bold lines in order to better distinguish the cylinder ports 46 from the arcuate slots 60,62,64.

As clearly illustrated by the drawing of FIG. 6, as the barrel 40 rotates in the clockwise direction, the leading edge 50 of the cylinder port 46 aligns with the leading edge 66 of the respective arcuate slots 60,62,64. The subsequent movement of the barrel 40 results in the cylinder port 46 opening into the associated arcuate slot 60/62/64. The initial area of the opening is large and for every increment of barrel rotation, the area of opening increases at a rapid rate. Likewise, as the trailing edge 52 of the cylinder port 46 approaches the trailing edge 68 of the associated arcuate slot 60/62/64, the area of the opening is quickly reduced to zero or to a fully closed off condition. As also clearly indicated by the drawing of FIG. 4, the circumferential length of the respective cylinder ports 46 is more than the circumferential space between adjacent slots 60,62,64. Consequently, at a given position of the barrel 40 relative to the port plate 26, the cylinder port 46 is at least partially open to both of the adjacent ones of the arcuate slots 60,64.

Even though the pressure transformer 10 described above is an axial pump design, it is recognized that other types of rotating units, such as bent axis or radial designs, could be used without departing from the essence of the subject invention. Any of these designs could also be variable displacement designs wherein the minimum to maximum displacement of the pistons 48 could be varied.

Additionally, even though the arcuate slots 60,62,64 of the port plate 26 are shown as extending completely through the port plate, it is recognized that the shape of the respective arcuate slots do not have to extend completely through the port plate 26. It is only important that the interface between the face 27 of the port plate 26 and the face 42 of the barrel 40 have the shape and size as defined above and have a depth that would not create an orifice for the flow therebetween.

The cylinder ports 46 and the arcuate slots 60,62,64 of the various embodiments show, at least in some portions, sharp corners that tend to create high stress risers. In order to reduce the possibility of stress risers in any corner of the ports or slots, it is recognized that small radii could be used at these corners in order to lower the stresses.

It is further recognized that the subject embodiments could also incorporate the traditional or well known bleed slots in combination with the special shaped porting in the port plate and/or barrel. Furthermore, it is recognized that the typical porting shape, i.e. round or oblong cylinder ports and arcuate slots having semi-circular ends, could be used in this invention to improve system efficiency over previous designs that do not permit overlap between the adjacent arcuate slots.

INDUSTRIAL APPLICABILITY

During operation of the subject pressure transformer 10, pressurized fluid is delivered from the source of pressurized fluid 14 and delivered to the first pressure port 30. The pressurized fluid is directed through the arcuate slot 60 in the port plate 26 and acts on the ends of the exposed pistons 48. This force effectively urges the barrel 40 to rotate in a well known manner. As the barrel 40 rotates, the exposed pistons 48 retract in the cylinders 44, thus filling the cylinders 44 with fluid.

In order to better understand the operation of the pressure transformer 10, one cylinder port 46 will be followed for one revolution. With reference to FIGS. 4,5,6 and at the TDC position, the one cylinder port 46 is open to the source of pressurized fluid 12 through the arcuate slot 60. As the barrel 40 moves in the clockwise direction due to the force of the pressurized fluid acting on the piston 48, the cylinder 44 is being filled with fluid and the piston is rapidly increasing in velocity as illustrated in FIG. 3. After the barrel 40 has moved through an angular rotation of about sixty degrees, the leading edge 50 of the cylinder port 46 begins to exit the arcuate slot 60. In the subject embodiment, the leading edge 50 of the cylinder port 46 coincides with the trailing edge 68 of the port plate 26. At this point, the communication of the source of pressurized fluid 12 with the cylinder port 46 begins to close off. As the barrel continues to rotate, the cylinder port 46 continues to close off.

Prior to the trailing edge 52 of the cylinder port 46 reaching the trailing edge 68 of the arcuate slot 60, the leading edge 50 of the cylinder port 46 opens into the arcuate slot 64. The area of communication quickly increases with each increment of movement of the barrel 40 while the communication of the cylinder port 46 remains open to the adjacent arcuate slot 60.

The total angular movement of the barrel 40, in which the cylinder port 46 is in communication with both of the adjacent arcuate slots, should remain generally small when the pressure transformer 10 is being operated at low RPMs and larger when the pressure transformer is being operated at higher RPMs. This is based on the fact that during the transition of the cylinder port 46 being closed off from one of the arcuate slots or being opened into the adjacent arcuate slot, the 'throttling effect' has a direct bearing on the effective seal between the adjacent arcuate slots. The final total angular movement requires optimizing the dynamic seal for a particular pressure and flow condition, which will set the rotational angle and RPM of the pressure transformer. Since the fluid is being compressed or expanded, depending on the position of the barrel 40 with respect to TDC, and the piston velocity is high, the dynamics of the fluid creates an effective seal (throttling effect) even though the cylinder port is still in communication with the associated arcuate slot. Consequently, due to the 'throttling effect', the dynamic seal length (effective seal) is longer than the static seal length. This permits a porting arrangement in which the adjacent arcuate slots are in communication with each other across the associated cylinder port but dynamically sealed from each other. This relationship improves the system efficiency since the fluid within the cylinders 44 is compressed or expanded such that the pressure within the cylinder is substantial equivalent to the successive port upon opening thereto. This creates a smooth transition which eliminates flow variations that are due to compression or expansion of the cylinder volume.

Once the trailing edge 52 of the cylinder port 46 reaches the trailing edge 68 of the arcuate slot 60, the cylinder port 46 is totally closed from the arcuate slot 60 and remains in communication with the arcuate slot 64. At this point in the rotation of the barrel 40, any pressure that is present in the cylinder 44 is relieved and the cylinder 44 continues to fill with fluid.

Once the cylinder port 46 reaches the BDC position, the cylinder 44 is full of fluid. In the subject embodiment, the cylinder port 46 begins to exit the arcuate slot 64. As the barrel 40 moves away from the BDC position, the fluid within the cylinder 44 begins to be expelled or compressed. Once the barrel 40 rotates to a position at which the trailing edge 52 of the cylinder port 46 nears the trailing edge 68 of the arcuate slot 64, the leading edge 52 of the cylinder port 46 enters the adjacent arcuate slot 62. As previously set forth, even though the adjacent slots 64,62 are open to each other across the cylinder port 46, they are dynamically sealed from each other.

As previously noted, the arcuate slot 62 is in communication with a work system 16 that is being operated at an intermediate pressure level as compared to the pressure in arcuate slots 60,64. As the barrel 40 continues to rotate, fluid from the cylinder 44 is continually expelled therefrom into the arcuate slot 62. Once the leading edge 50 of the cylinder port 46 reaches the trailing edge 68 of the arcuate slot 62, the area of communication is again reduced. Once the barrel 40 rotates to a position at which the trailing edge 52 of the cylinder port 46 nears the trailing edge 68 of the arcuate slot 62, the leading edge 52 of the cylinder port 46 enters the adjacent arcuate slot 60. As previously set forth, even though the adjacent slots 62,60 are open to each other across the cylinder port 46, they are dynamically sealed from each other.

Once the leading edge 50 of the cylinder port 46 passes the leading edge 66 of the arcuate slot 60, the fluid in the cylinder 44 is passed to the arcuate slot 60 which is in communication with the source of pressurized fluid 12. Once the cylinder port 46 reaches the TDC position, all of the fluid in the cylinder 44 has been expelled. The force of pressurized fluid from the source 12 again applies a force to the piston 48 to force the piston 48 to retract, thus starting the cycle over again.

It is recognized that in some pressure transformer 10 it may be desirable to not permit the adjacent arcuate slots to be in communication with each other across the cylinder ports 46. In the locations in which the cylinder velocities are low, it may be desirable to have the adjacent arcuate slots totally, statically blocked from one another while in other locations where piston velocities are high, it may be desirable to provide communication but have the communication dynamically sealed. By providing a combination of total static sealing between adjacent arcuate slots and dynamic sealing between other adjacent slots, the overall system efficiencies can be further improved.

In order to alter the level of pressure in the arcuate slot 62, the port plate 26 is rotated in the housing 20. As viewed in FIG. 6, rotation of the port plate 26 in the clockwise direction results in the pressure level in the arcuate slot 62 increasing. The pressure level in the arcuate slot 62 can be higher than the pressure level of the fluid in the arcuate slot 60 if the port plate 26 is rotated far enough in the clockwise direction. Likewise, the pressure level in the arcuate slot 62 can be reduced to a zero pressure level if the port plate, is rotated far enough in the counterclockwise direction. Additional details of the operation of the pressure transformer 10 can be obtained from a review of PCT publication number WP 97/31185 published Aug. 28, 1997.

From the foregoing description, it is readily apparent that the use of the porting relationship described herein greatly improves the operating efficiency of the subject transformer over that previously known. The improved operating efficiency is based largely on providing a controlled amount of communication between adjacent arcuate slots across the respective cylinder ports 64 so that a dynamic seal can be provided. The dynamic seal is created by the effects of the fluid within the associated cylinders 44 and the velocity of the pistons 48 in the cylinders. By utilizing the dynamic seal effect, the fluid within the respective cylinders is conditioned so that the pressure within the cylinder is equivalent to the pressure within the successive arcuate slot upon opening thereto.

Other aspects, objects and advantages of this invention can be obtained from a study of the drawings, the disclosure and the appended claims.

I claim:

1. A pressure transformer for the conversion of hydraulic power from a first fluid flow having a first fluid pressure into the hydraulic power of a second fluid flow having a second pressure by controlling a third fluid flow having a third pressure, the hydraulic pressure transformer having a housing with three port connections, a rotating group having a barrel with a face surface and a plurality of piston assemblies each slideably disposed in respective cylinders that have cylinder ports defined in the barrel and opening to the face surface, each of the cylinder ports are spaced from one another around a predetermined circumference, a displacement control mechanism operatively associated with the respective piston assemblies to control the volume of fluid within each cylinder between a minimum and a maximum volume as the rotating group rotates, and an adjustable port plate having a face surface with three arcuate slots defined therein spaced from one another around a predetermined circumference that is substantially equal to the predetermined circumference of the cylinder ports, the face surface of the adjustable port plate being in mating contact with the face surface of the rotating group and each of the three arcuate slots being in communication with respective ones of the three ports in the housing, the pressure transformer comprising:

each cylinder port having a leading edge, a trailing edge, and first and second spaced apart circumferential sides, the leading edge and the trailing edge of each cylinder port being spaced from one another a predetermined circumferential distance;

each arcuate slot having a leading edge, a trailing edge, and first and second spaced apart circumferential sides, the trailing edge of one of the arcuate slots and the leading edge of an adjacent slot being spaced from one another a predetermined circumferential distance along the predetermined circumference, the predetermined distance between the adjacent slots being less than the predetermined distance between the leading edge and the trailing edge of the respective cylinder slots; and during relative rotation between the barrel and the port plate, the leading edge of the respective cylinder ports is in an open overlapping relationship with one of the arcuate slots and the trailing edge of the same cylinder port is in an open overlapping relationship with the second one of the arcuate slots.

2. The pressure transformer of claim 1 wherein the circumferential space between the second one of the arcuate slots and the third one of the arcuate slots is less than the circumferential space between the leading and trailing edges of the respective cylinder ports.

3. The pressure transformer of claim 2 wherein the rotating group has a top dead center position and a bottom dead center position and the space between the first one of the arcuate slots and a second one of the arcuate slots is at a location between the top and bottom dead center positions of the rotating group.

4. The pressure transformer of claim 3 wherein at various locations during relative rotation of the barrel and the port plate, the leading edge of the respective cylinder ports and the leading edge of the respective arcuate slots are radially concurrent.

5. The pressure transformer of claim 4 wherein at various locations during relative rotation of the barrel and the port plate, the trailing edge of the respective cylinder ports and the trailing edge of the respective arcuate slots are radially concurrent.

6. The pressure transformer of claim 5 wherein at various locations during relative rotation of the barrel and the port plate, the leading edge of the respective cylinder ports and the trailing edge of the respective arcuate slots are radially concurrent.

7. The pressure transformer of claim 3 wherein the space between the first one of the arcuate slots and a third one of the arcuate slots is at a location between the top and bottom dead center positions of the rotating group.

8. The pressure transformer of claim 7 wherein only one of the spaces between the respective arcuate slots is at the top or bottom dead center positions at any given instance.

* * * * *